US010350661B2

(12) United States Patent
Denkmeier

(10) Patent No.: US 10,350,661 B2
(45) Date of Patent: Jul. 16, 2019

(54) TOOL SET-UP SYSTEM FOR A BRAKE PRESS

(71) Applicant: TRUMPF Maschinen Austria GmbH & Co. KG., Pasching (AT)

(72) Inventor: Thomas Denkmeier, Traun (AT)

(73) Assignee: TRUMPF Maschinen Austria GmbH & Co. KG, Pasching (AT)

( * ) Notice: Subject to any disclaimer, the term of this patent is extended or adjusted under 35 U.S.C. 154(b) by 605 days.

(21) Appl. No.: 15/039,112

(22) PCT Filed: Nov. 26, 2014

(86) PCT No.: PCT/AT2014/050281

§ 371 (c)(1),
(2) Date: May 27, 2016

(87) PCT Pub. No.: WO2015/077810

PCT Pub. Date: Jun. 4, 2015

(65) Prior Publication Data

US 2017/0165734 A1 Jun. 15, 2017

(30) Foreign Application Priority Data

Nov. 26, 2013 (AT) ..... A 50781/2013

(51) Int. Cl.
*B21D 37/12* (2006.01)
*B21D 5/02* (2006.01)
*B21D 37/14* (2006.01)

(52) U.S. Cl.
CPC ..... *B21D 5/0254* (2013.01); *B21D 37/14* (2013.01); *B21D 37/145* (2013.01)

(58) Field of Classification Search
CPC .... B21D 5/0254; B21D 37/14; B21D 37/145; B21D 5/004; B21D 5/0218; B21D 5/0209; B23Q 3/155
(Continued)

(56) References Cited

U.S. PATENT DOCUMENTS 4,089,198 A 5/1978 Amano et al.
4,532,792 A * 8/1985 Hongo ..... B21D 5/04 72/319

(Continued)

FOREIGN PATENT DOCUMENTS

DE 37 31 871 A1 4/1989
EP 0 392 795 A2 10/1990

(Continued)

OTHER PUBLICATIONS

International Search Report of PCT/AT2014/050281, dated Mar. 9, 2015.

*Primary Examiner* — David B Jones
(74) *Attorney, Agent, or Firm* — Collaard & Roe, P.C.

(57) ABSTRACT

The invention relates to a production plant (1) comprising a brake press (3) having press beams (13, 16), slot-shaped tool holders (19, 20) disposed and/or arranged on the press beams (13, 16), bending tools (4), a tool magazine (31) for at least one bending tool (4), a first manipulation device (30) for transporting the bending tool (4) between the tool magazine (31) and the tool holders (19, 20), and a second manipulation device (33) for positioning the bending tool (4) in the tool holder (19, 20). The second manipulation device (33) comprises at least one traction means (37) guided via two deflection means (35, 36), on which traction means (37) at least one pusher element (38) is disposed. The bending tool (5, 6) has a slot (46) extending in a direction (48) parallel with a bending edge (47) through which the at least one traction means (37) is run. The at least one slot (46) is further dimensioned such that the at least one pusher element (38) cannot be run through the slot (46).

12 Claims, 6 Drawing Sheets

Figure 1:
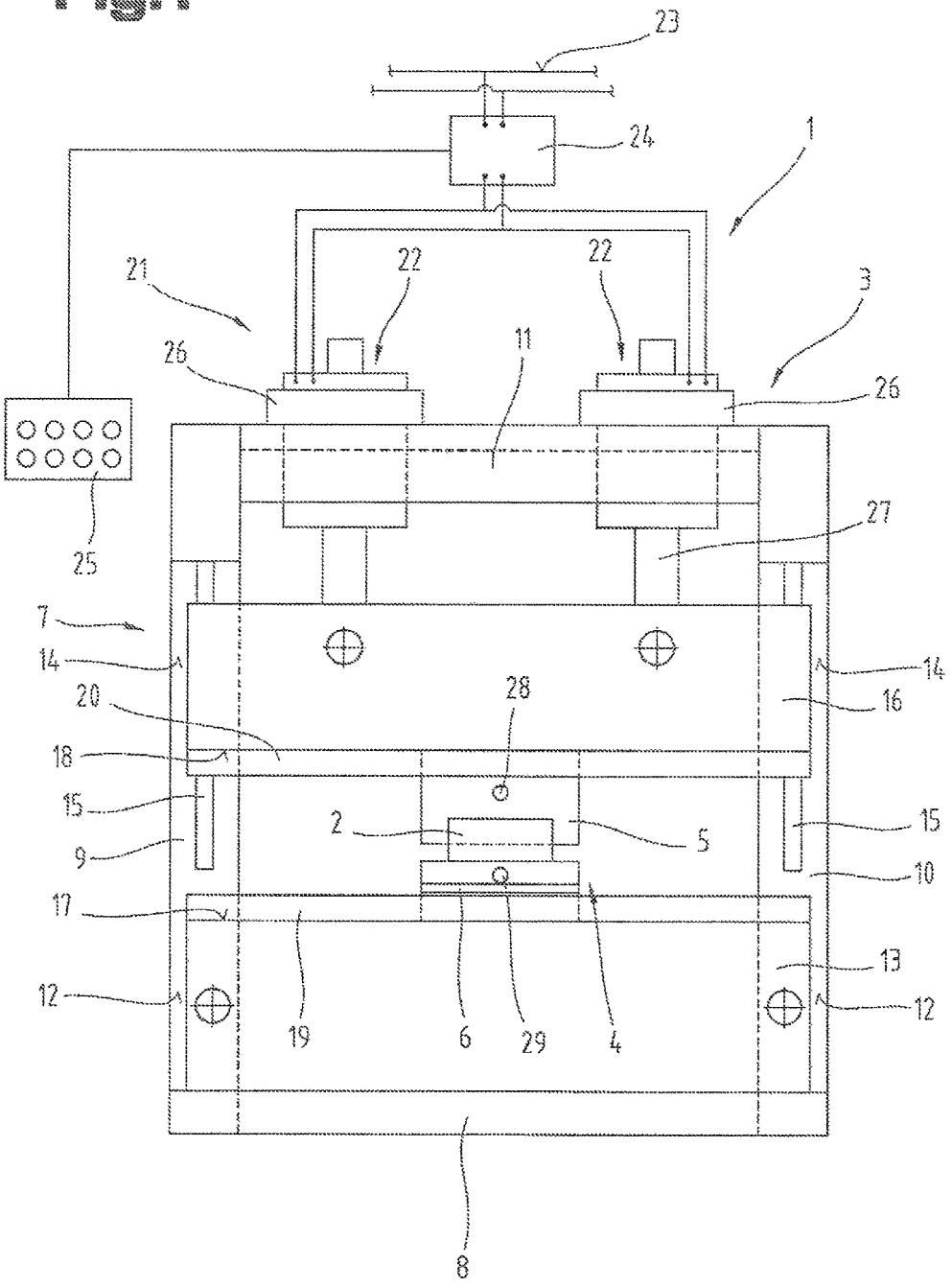

(58) Field of Classification Search
USPC ..... 72/389.4
See application file for complete search history.

(56) References Cited

U.S. PATENT DOCUMENTS

| | | | | | |
|---|---|---|---|---|---|
| 4,680,955 | A * | 7/1987 | Sakamoto | B21D 5/02 | 100/918 |
| 4,945,629 | A | 8/1990 | Schafft | | |
| 5,134,873 | A | 8/1992 | Miyagawa et al. | | |
| 5,168,745 | A * | 12/1992 | Miyagawa | B21D 5/02 | 483/29 |
| 6,656,099 | B1 * | 12/2003 | Akami | B21D 5/02 | 483/29 |
| 9,975,161 | B2 * | 5/2018 | Sato | B21D 5/004 | |
| 2007/0271987 | A1 * | 11/2007 | Shimizu | B21D 5/02 | 72/381 |
| 2009/0139296 | A1 * | 6/2009 | McCauley | B21D 5/0209 | 72/482.2 |

FOREIGN PATENT DOCUMENTS

| | | | |
|---|---|---|---|
| EP | 0 894 550 | A2 | 2/1999 |
| EP | 2 138 247 | A2 | 12/2009 |
| FR | 2 317 027 | A1 | 2/1977 |
| JP | S57-31422 | A | 2/1982 |
| JP | S58-148021 | A | 9/1983 |
| JP | S61-103626 | A | 5/1986 |

* cited by examiner

TOOL SET-UP SYSTEM FOR A BRAKE PRESS

CROSS REFERENCE TO RELATED APPLICATIONS

This application is National Stage of PCT/AT2014/050281 filed on Nov. 26, 2014, which claims priority under 35 U.S.C. § 119 of Austrian Application No. A 50781/2013 filed on Nov. 26, 2013, the disclosure of which is incorporated by reference. The international application under PCT article 21(2) was not published in English.

The invention relates to a production plant with a brake press, as specified in claim 1.

Various different devices which enable bending tools to be automatically set up on a brake press are known from the prior art. A manipulator robot or the rear stop unit is usually used to set up the bending tools on the bending machine. To this end, the bending tool is taken out of the tool magazine by means of the manipulator robot or rear stop unit and positioned in the tool holder depending on the tool holder system. One possible option in this respect is for the bending tool to be pushed into the tool holder in a lengthways direction and thus positioned. Another option is for the bending tool to be inserted in its end position directly by the manipulator robot or rear stop unit in a direction perpendicular to the lengthways direction, in which case a catch mechanism must be provided in the bending tool for inserting the tool.

The disadvantage of these systems is that the manipulator robot or rear stop unit must have a large working range to enable the bending tools to be positioned along the entire longitudinal extension of the tool holder. As a result, the manipulator robot or rear stop unit is very complex and very heavy. The bending tools may also be taken out of the tool magazine and inserted in the tool holder one by one but this requires a considerable amount of time.

Devices are also known whereby a bending tool is inserted in the tool magazine by a manipulator device and then positioned in the longitudinal direction of the tool magazine by means of a spindle drive or by means of a toothed rack.

The disadvantage of these systems is that a spindle drive or toothed rack is complex in terms of manufacture and thus expensive. Furthermore, separate holder systems have to be used to hold the bending tools when working with a drive method of this type, which further increases the complexity of the production plant.

The objective of this invention is to propose a production plant for air bending workpieces to be produced from sheet metal, which has an improved device for setting up the tools.

This objective is achieved by the invention on the basis of the features defined in claim 1.

The invention proposes a production plant, in particular for air bending workpieces to be produced from sheet metal. The production plant comprises a bending press, in particular a brake press, having a machine frame and press beams as well as slot-shaped tool holders formed and/or disposed on the press beams, bending tools in the form of a bending punch or a bending die, a tool magazine for at least one bending tool, a first manipulation device for transporting the bending tool between the tool magazine and the tool holders, and a second manipulation device for positioning the bending tool in a lengthways direction of the tool holder, and the second manipulation device comprises a traction means guided via at least two deflection means, on which traction means at least one pusher element is provided. The bending tool comprises at least one slot extending in a direction parallel with a bending edge across the length of the bending tool through which the at least one traction means is run, and the at least one slot is further dimensioned such that the at least one pusher element cannot be run through the slot.

One advantage of the system proposed by the invention is that the second manipulation device for positioning the bending tools based on such a design can be made up of a few easily assembled individual parts. As a result, not only can the manipulation device be made as robust as possible in spite of being of a lightweight construction, it is also inexpensive to manufacture. Furthermore, a manipulation device based on such a design requires very little maintenance. Due to the very simple design, the manipulation device is also not excessively prone to faults. The feature whereby the traction means is guided in a slot of the bending tool is of advantage because the traction means can be protected from environmental influences, thereby preventing damage to the traction means. Furthermore, combining a manipulation device for inserting the bending tools with a manipulation device for positioning the bending tools is very advantageous because set-up times can be significantly reduced.

Furthermore, the at least one traction means may be provided in the form of a cable. The advantage of this is that a traction means in the form of a steel cable, for example, is particularly robust and resistant. A traction means in the form of a cable is not very susceptible to wear and is capable of absorbing high forces, even based on relatively small dimensions. Another advantage is the fact that a cable can be easily deflected and there is no need for a pulley based on complicated geometry.

It may also be of practical advantage if the at least one pusher element extends around the traction means and has a substantially rotationally symmetrical shape. The advantage of this is that a pusher element with a substantially rotationally symmetrical shape does not have to be fitted on the traction means in a specific angular position. In addition, using a pusher element with a rotationally symmetrical shape means that any turning of the traction means during operation will not have a detrimental effect on the functionality of the manipulation device. This is of particular advantage if using a cable as the traction means because a cable is not very stable in terms of twisting about its longitudinal axis. This is especially the case with an endless cable guided around two deflection means. Such a pusher element which extends around the traction means can firstly be centrally disposed on the traction means. Secondly, such a pusher element can be equipped with a simple fixing system so that it can easily be fitted on the traction means.

The working range of the at least one traction means may also extend substantially across the entire length of the tool holder. The advantage of this is that the bending tools can be positioned across the entire length of the tool holder. This is made possible because the working range on the side of the machine connected to the tool magazine is made slightly shorter.

It may also be of practical advantage if the second manipulation device is positioned such that at least a partial portion of the at least one traction means extends inside the clear cross-section of the slot-shaped tool holder so that it can be moved into abutment with the bending tool. The advantage of this is that the traction means is very well protected from environmental influences. The space needed for the second manipulation device can also be kept small. This is because the main component units of the second manipulation device can be disposed inside the tool holder.

As a result, the number of parts protruding from the tool holder is kept to the minimum possible.

It may also be of advantage if a first traction means is provided as a means of setting up the bending tools, by means of which the bending tools can be positioned in a first direction of the lengthways direction of the tool holder and a second traction means is provided, by means of which the bending tools can be positioned in a in second direction opposite the first direction. As a result, the individual bending tools can be easily and rapidly positioned. This is achieved due to the fact that a pusher element mounted on the traction means can be positioned on one side of the brake press, in particular the tool holder, in each case. The bending tools can therefore be selectively pushed in the first direction or in the second direction without a pusher element having to be pushed to the second side of the bending tools. This also means that the bending tools can be pushed together, for example, to enable gaps between the individual bending tools to be reduced.

Based on one specific embodiment, the second manipulation device may comprise at least two cable drums connected to a drive unit, between which the at least one cable-shaped traction means is tensed and on which cable drums the at least one cable-shaped traction means can be alternately reeled. The advantage of this is that by using two driven cable drums on which the cable-shaped traction means can be alternately reeled, an endless traction means is not necessary. The mounting space needed can therefore be kept as small as possible. This also means that there is no need for a tensioning device in which a continuously circulating cable would have to be tensioned.

Alternatively, the second manipulation device may comprise at least one drive unit which is coupled with a deflection means in a driving arrangement, by means of which drive unit the traction means can be moved and positioned, and the traction means is provided in the form of a circulating endless traction means. The advantage of this is that by contrast with the embodiment based on alternately reeling the traction means on two cable drums, only one driven deflection unit is needed. A manipulation device based on this design is significantly cheaper to make than a manipulation device with two driven deflection means.

Based on another embodiment, the deflection unit may be provided in the form of a pulley. The advantage of providing the deflection unit in the form of a pulley is that a pulley is simple to manufacture. This means that the manufacturing process is less susceptible to faults and is inexpensive. Furthermore, a pulley is not subjected to very much wear and maintenance costs can also be kept low.

It may also be of practical advantage if at least one deflection means can be displaced transversely to the lengthways direction of the tool holder, as a result of which the pusher element secured to a partial portion of the traction means can be moved into abutment with the bending tool. The advantage of this is that due to this feature, the pusher element mounted on the traction means which normally sits in abutment with the bending tool to the degree that the bending tool can be pushed by the traction means, can be moved in the vertical direction to the extent that it is no longer actively abutting with the bending tool. As a result, the pusher element can be positioned on the opposite side of the bending tool or bending tools so that the bending tools can be pushed selectively in the first direction or in the second direction along the lengthways direction of the tool holder using only one pusher element.

Based on another embodiment, a guide element may be provided which is displaceable between the deflection means transversely to the lengthways direction of the tool holder and which acts on a partial portion, as a result of which the pusher element secured to the partial portion of the traction means can be moved into abutment with the bending tool. The advantage of this is that as a result of such a feature, the deflection means do not have to be pushed transversely to the lengthways direction of the tool holder because the traction means and pusher element can be moved into active abutment with a bending tool by means of the guide element.

It may also be of advantage if the traction means is reeled multiple times around at least one deflection means. This may be necessary in the case of deflection means which are used as a drive for the traction means. It may be of particular advantage to opt for a multiple reeling system if high forces have to be absorbed, especially if using a cable as the traction means, to enable sufficient frictional force to be applied.

To provide a clearer understanding, the invention will be described in more detail below with reference to the appended drawings.

Figure 2:
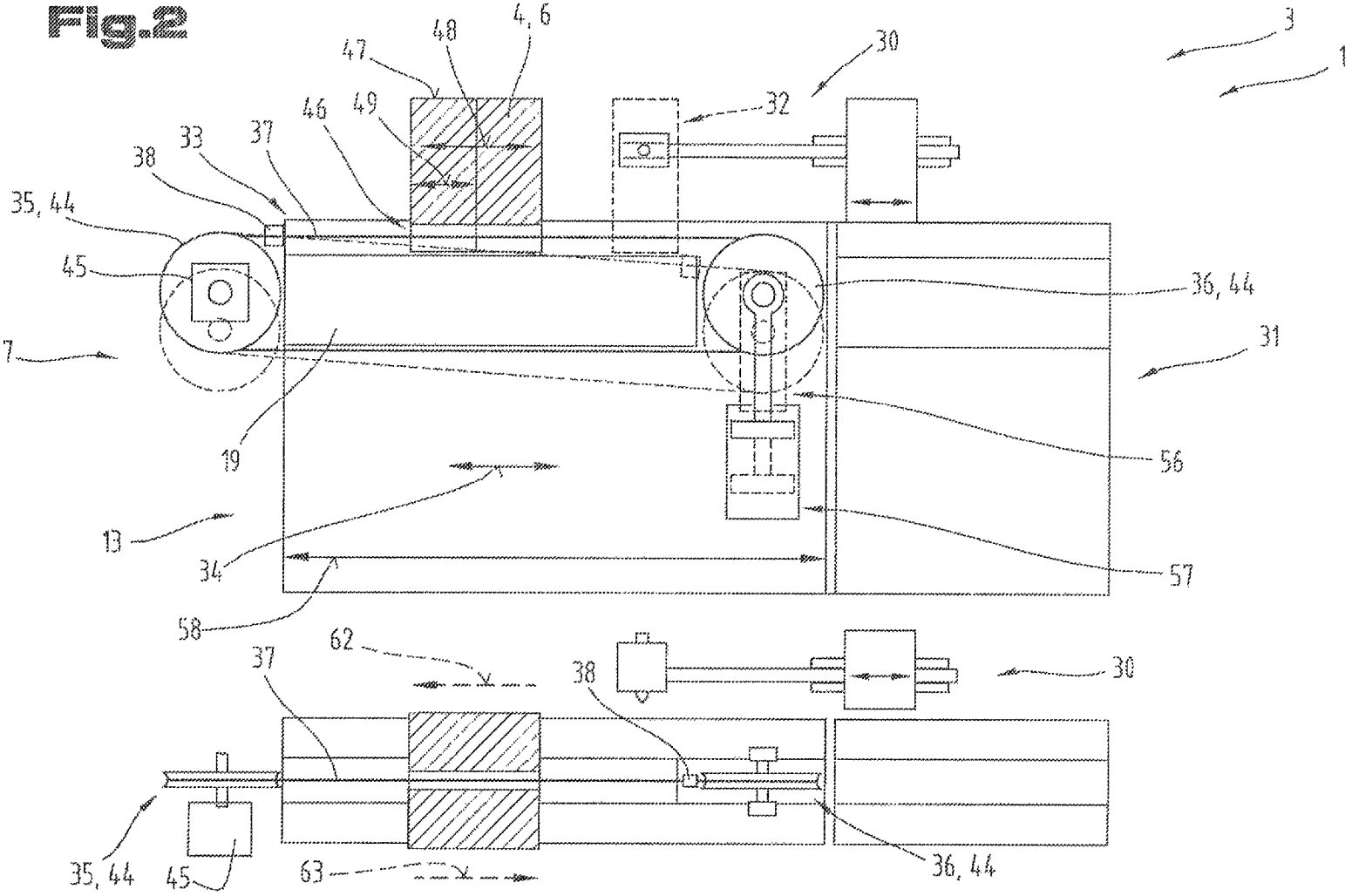
Figure 3:
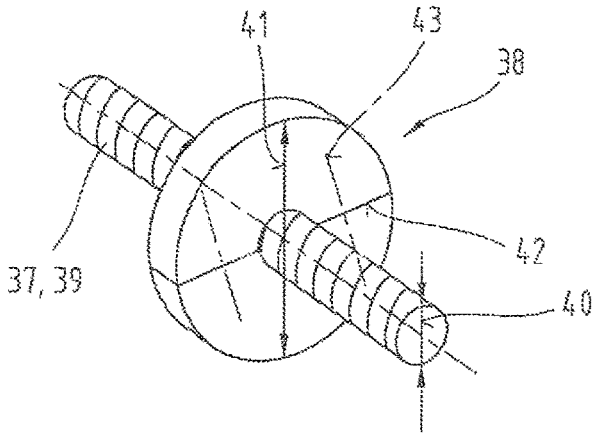
Figure 4:
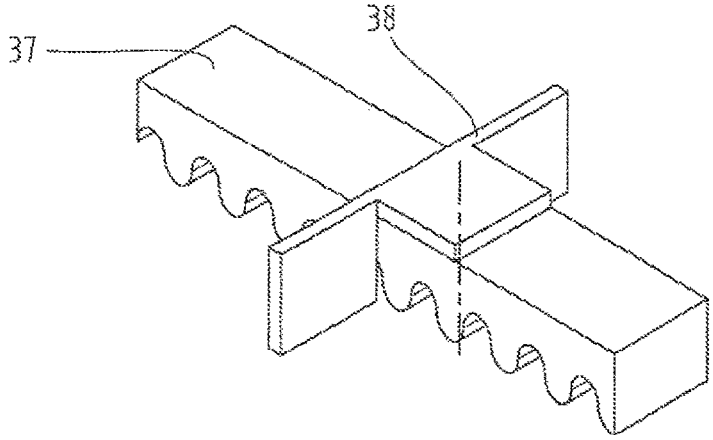
Figure 5:
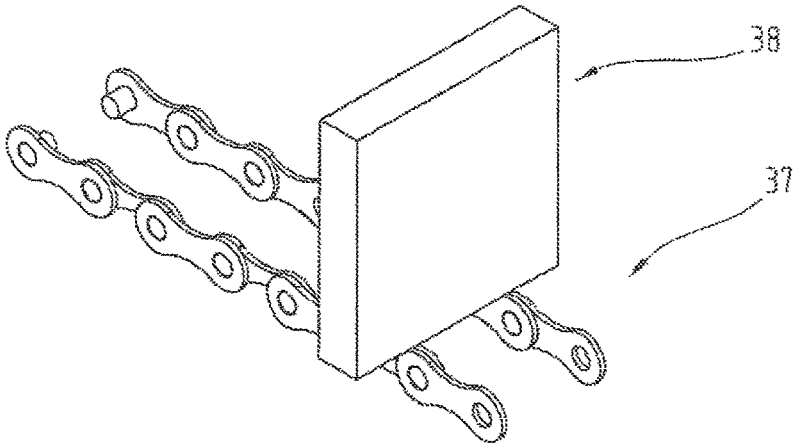
Figure 6:
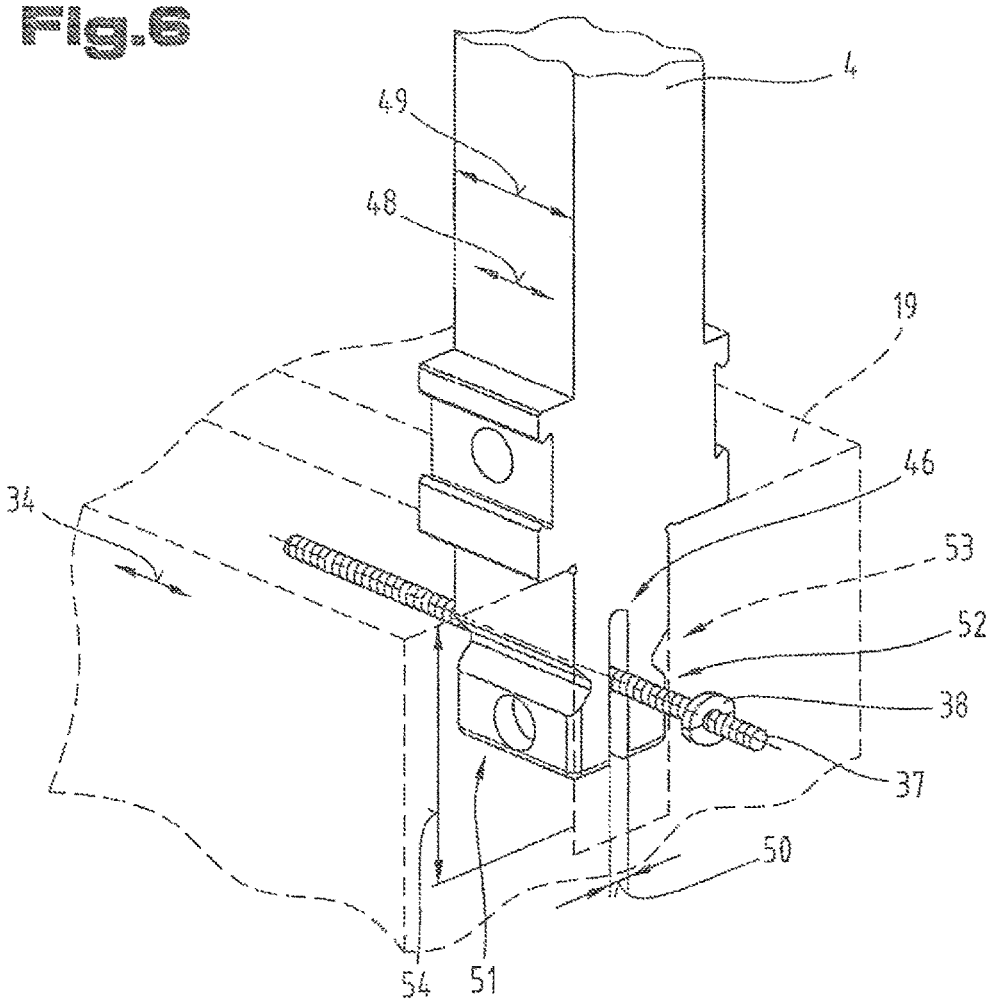
Figure 7:
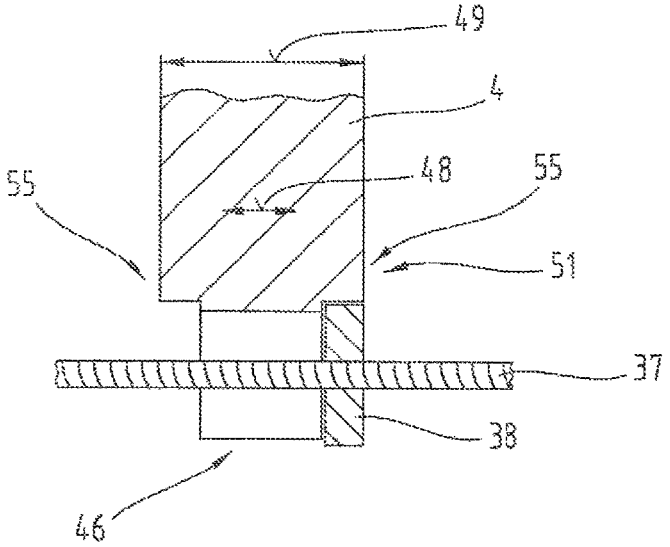
Figure 8:
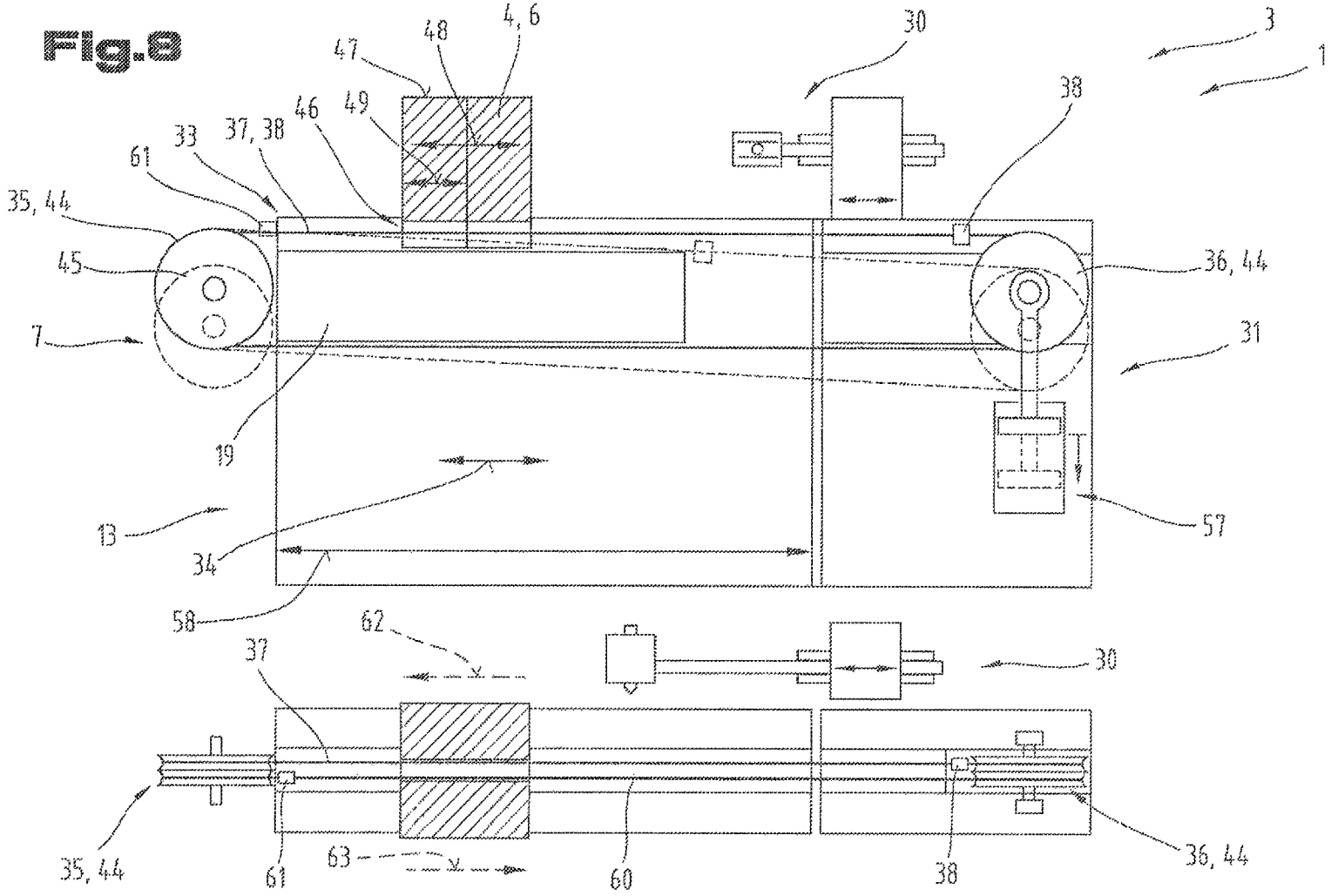
Figure 9:
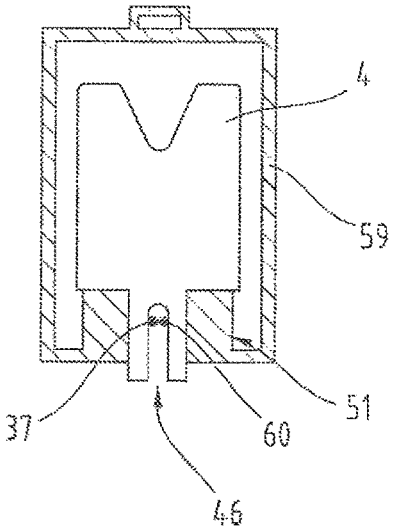
Figure 10:
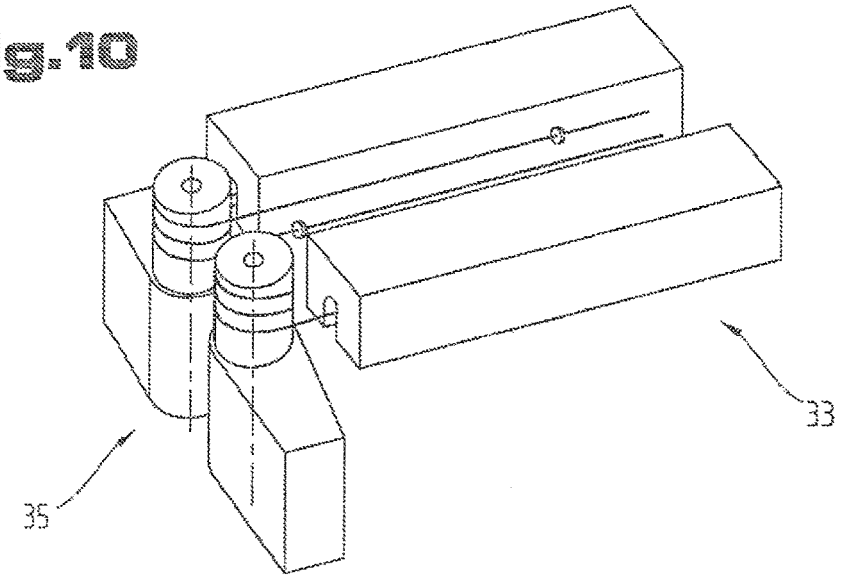
Figure 11:
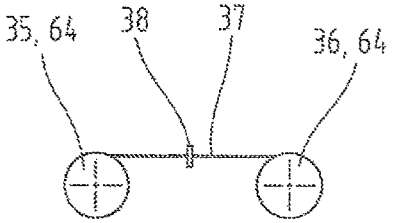
Figure 12:
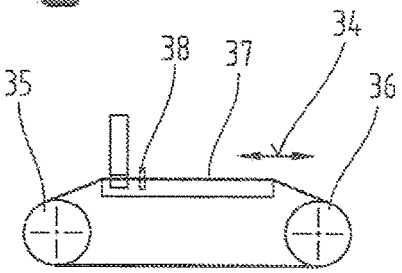

These are highly simplified, schematic diagrams illustrating the following:

FIG. 1 a view in elevation of a production plant with a brake press;

FIG. 2 a view in elevation and an associated plan view of a brake press with two manipulation devices;

FIG. 3 a perspective view of a traction means in the form of a cable with a pusher element;

FIG. 4 a perspective view of a traction means in the form of a toothed belt with a pusher element;

FIG. 5 a perspective view of a traction means in the form of a chain with a pusher element;

FIG. 6 a bending tool with a slot and a traction means having a pusher element running through it;

FIG. 7 a section through a bending tool, specifically through the tool clamping portion, and a traction means having a pusher element running through it;

FIG. 8 a view in elevation and an associated plan view of a brake press with two manipulation devices, a second manipulation device being extended into the tool magazine;

FIG. 9 a tool collection device with bending tools accommodated in it;

FIG. 10 a schematic diagram of another possible embodiment of deflection means of the second manipulation device, in the form of spindles;

FIG. 11 a schematic diagram of another possible embodiment of deflection means of the second manipulation device, in the form of cable drums;

FIG. 12 a schematic of diagram another possible embodiment of the second manipulation device with a guide element.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIGS. 1 to 12 are schematically simplified diagrams illustrating a production plant 1 for air bending workpieces to be produced from sheet metal 2 and different embodiments thereof.

The production plant 1 comprises a brake press 3, in particular a bending press, for producing workpieces 2 or parts between bending tools 4 which can be displaced relative to one another, such as a bending punch 5 and bending die 6. The bending punch 5 may also be referred to as the top tool and the bending die 6 as the bottom tool.

A machine frame 7 of the brake press 3 comprises a base plate 8 for example, on which vertically extending side panels 9, 10 can be disposed, spaced apart from one another in the transverse direction and oriented parallel with one another. The latter are preferably connected to one another at their end regions spaced apart from the base plate 8 by means of a solid transverse bracing 11, for example made from a sheet metal part.

To provide space for forming the workpiece 2, the side panels 9, 10 may be approximately C-shaped, and a stationary press beam 13 may be secured to front faces 12 of legs of the side panels 9, 10 close to the floor, in particular standing on the base plate 8. This press beam 13 may also be described as a table beam. Mounted on legs of front faces 14 remote from the base plate 8 is another press beam 16, in particular a compression beam, which can be displaced in linear guides 15 relative to the press beam 13 forming the table beam. Tool holders 19, 20 for setting up the bending tools 4 may be provided or disposed on opposing end faces 17, 18 of the two press beams 13, 16 extending parallel with one another.

As a drive system 21 for the displaceable press beam 16, namely the compression beam, the illustrated brake press 3 has at least one, in this instance two, drive means 22, which are supplied with electricity from a power supply network 23, for example, and which can also be connected to a control device 24 by cabling. Operation of the brake press 3 is controlled from an input terminal 25 wired to the control device 24, for example.

The drive means 22 may comprise spindle drives 26 driven by electric motors, for example, of a generally known type, connected in a drive arrangement to actuator means 27 to enable a reversible positioning movement of the top press beam 16 constituting the compression beam, for example. Independently of the above, it would also be possible to provide the drive means 22 in the form of hydraulically and/or pneumatically operable actuator means. Cylinder/piston systems may be used for this purpose. It would also be conceivable to use other types of drive means, e.g. eccentric drives, toggle drives, rack and pinion drives, etc.

All of the embodiment features and individual features mentioned above in the description of the drawings are given as examples of a production plant 1 and brake press 3 which can be used in conjunction with what follows in the description of the drawings below constituting the essential features of the invention. Accordingly, all of these individual features are not absolutely necessary for the solution proposed by the invention and can be omitted or replaced by other features in order to obtain a functional brake press 3.

To avoid making this description unnecessarily long, additional details relating to operation of a brake press 3 of this type will not be given in the substantive part of the description, for example relating to safety devices, stop arrangements, control and measuring systems.

The production plant 1 may include a manipulator that will also not be described, provided as a means of taking from a stack of metal sheets to be formed or bent at least one piece and carrying it to within the working range or operating side of the brake press 3.

It should also be briefly pointed out that the bending tools 4, in particular the bending punch 5 and/or bending die 6, may be respectively provided with orifices 28, 29 enabling them to be manipulated. Manipulating the bending tool 4 should be understood as meaning that it or its bending punch 5 and/or bending die 6 is removed from a tool magazine 31, schematically illustrated in FIG. 2, on an automated basis by means of a first manipulation device 30 and automatically transported to an insertion position 32 of the tool holders 19, 20 of the press beam 13, 16, where it is then inserted and held in a clamped arrangement. This can also be described as a tool changing system by means of which operations of replacing tools with parts necessary for production can be carried out.

This first manipulation device 30 may be provided in the form of a manipulator which is used for handling workpieces, for example. The manipulation device 30 may also be provided in the form of a rear stop unit, for example, which is configured to carry out manipulation activities. In addition to this and other possible embodiments, it is also possible to provide a separate manipulator as the manipulation device 30 which is then used for the specific purpose of handling bending tools.

The embodiment of a device for setting up bending tools illustrated in FIGS. 2 to 12 will be explained with reference to a bottom tool holder 19. In the same way as described in this context, it is also possible to set up a top tool holder 20 with bending tools 4. To keep the description short, however, an exact description and illustration of such a top tool holder 20 will not be given.

FIG. 2 is a schematic diagram showing a view in elevation of a brake press 3, in particular the first press beam 13 and first tool holder 19. As clearly illustrated, in addition to a first manipulation device 30, a second manipulation device 33 is also provided in the production plant, which is designed to transport the bending tools 4 from the insertion position 32 to their final position along the lengthways direction 34 in the tool holder 19.

To this end, the manipulation device 33 comprises at least one traction means 37 which is guided via two deflection means 35, 36 and which is provided with at least one pusher element 38.

To provide a clearer understanding of the design of such a manipulation device 33, FIGS. 3 to 5 illustrate different possible embodiments of traction means 37 and pusher elements 38.

As illustrated in FIG. 3, the traction means 37 may be provided in the form of a cable 39, for example. Such a cable 39 may be a standard steel cable or plastic cable. The diameter 40 of the cable 39 will depend on the traction force to be applied and is preferably between 1 mm and 5 mm.

It is also possible to provide the traction means 37 in the form of a toothed belt or V-belt or flat belt, as illustrated in FIG. 4.

Based on yet another variant, the traction means 37 may be provided in the form of a chain, as illustrated in FIG. 5.

There are many possible options for such a traction means 37 but they are not restricted to the specific examples mentioned here. It would also be conceivable to use other types of traction means as the traction means 37 in the manipulation device 33.

Like the traction means 37, the pusher element 38 may also be based on a range of different embodiments, and the embodiments illustrated in FIG. 3 to FIG. 5 represent a small selection of possible designs.

The pusher element 38 illustrated by way of example in FIG. 3 may be a cylindrical element, for example, which is secured on the traction means 37. This pusher element 38 in the form of a cylindrical element has a bigger diameter 41 than the cable diameter 40. Various different fixing systems may be used to fit the pusher element 38 on the traction means 37. For example, it would be conceivable for the pusher element 38 to have a parting plane 42 extending through the central axis of the cylindrical element, by means of which the pusher element 38 is split into two halves. The pusher element 38 can therefore be easily fitted on the traction means 37 and secured by fixing means 43. It would also be conceivable for the two halves of the pusher element 38 created by the parting plane 42 to be joined to one another and secured to the traction means 37 by a material connection, for example, such as a bonded connection, soldered connection or welded connection.

As illustrated in FIG. 4, the pusher element 38 may also be provided in the form of a flat product which can be secured by a fixing means 43 to the traction means 37, such as a toothed belt. To this end, the pusher element 38 may either be screwed directly to the traction means 37 or a counter-holder may be provided, for example, by means of which the pusher element 38 is screwed and thus clamped to the traction means 37.

As illustrated in FIG. 5, another option is for the pusher element 38 to be directly secured to the traction means 37, in which case a simple, projecting plate is provided. It would also be conceivable for the pusher element 38 to be provided in the form of a chain link, for example, in which case it is part of the chain illustrated in FIG. 5. The embodiments of the pusher element 38 and means for fixing it on the traction means 37 are also not restricted by the examples of embodiments illustrated in FIG. 3 to FIG. 5 and it would also be conceivable to use other types of pusher elements 38 and fixing means 43.

The described embodiments of different traction means 37 and pusher elements 38 may be used on the manipulation device 33 illustrated in FIG. 2.

Having explained the possible designs of different traction means 37 and pusher elements 38, possible options for the design of the manipulation device 33 will now be described in more detail with reference to FIG. 2.

Based on one possible embodiment, as illustrated in FIG. 2, the traction means 37 is guided across two deflection means 35, 36, the deflection means 35, 36 being provided in the form of pulleys 44 and the traction means 37 as a circulating endless traction means. To this end, one of the deflection means 35, 36 may be connected in a driven arrangement to a drive 45 so that the traction means 37 can be circulated about the two deflection means 35, 36 and the pusher element 38 coupled with the traction means 37 can therefore be moved along the lengthways direction 34 of the tool holder 19.

To enable bending tools 4 to be moved and positioned using a manipulation device 33 based on this design, a slot 46 is provided in the bending tool 4, disposed along a direction 48 parallel with a bending edge 47, as illustrated in detail in FIG. 6 and FIG. 7. Such a slot 46 preferably extends across the entire length 49 of the bending tool 4.

To enable the bending tool 4 to be pushed and positioned in a lengthways direction 34 of the tool holder 19, the traction means 37 may run inside the slot 46 of the bending tool 4. The traction means 37 can then be moved in a direction 48 parallel with the bending edge 47 until the pusher element 38 makes contact with the bending tool 4 and the bending tool 4 can therefore be pushed by the pusher element 38 in the lengthways direction 34 in the tool holder 19.

Based on one advantageous variant, the bending tool 4 may be designed as illustrated in FIG. 6. The slot 46 provided in the bending tool 4 preferably has a width 50 which is selected so as to be big enough to enable the traction means 37 to pass through the slot 46 without contact. The width 50 of the slot 46 is selected such that the pusher element 38 is not able to pass through the slot 46 and can therefore move into contact with the bending tool and set the bending tool 4 in motion.

The slot 46 is preferably arranged in the bending tool 4 in such a way that it is disposed within the tool clamping portion 51 of the bending tool 4. The tool clamping portion 51 is that part of the bending tool 4 which is designed to enable the bending tool 4 to be held and clamped in one of the tool holders 19, 20.

The manipulation device 33 is preferably positioned so that at least a partial portion 52 of the at least one traction means 37 is disposed inside the clear cross-section 53 of the slot-shaped tool holder 19, 20. The bending tool 4, in particular the tool clamping portion 51 of the bending tool 4, is secured and clamped in the clear cross-section 53 of the tool holder 19, 20.

The tool clamping portion 51 is therefore fully accommodated in the clear cross-section 53. To guarantee operation of the manipulation device 33 in a bending tool arrangement such as that illustrated in FIG. 6, the clear cross-section 53 is preferably designed with a depth 54 that is big enough to allow a space to be left free underneath the tool clamping portion 51 of the bending tool 4 through which the traction means 37 together with the pusher element 38 is able to pass. As a result, the pusher element 38 can be re-positioned from one side of the bending tool 4 in a direction 48 parallel with the bending edge 47 to the opposite side of the bending tool 4 in a direction 48 parallel with the bending edge 47. The bending tool 4 can therefore be pushed selectively in a first or a second direction.

As illustrated in FIG. 7, a recess 55 or two mutually opposite recesses 55 may be provided in the bending tool 4, which are disposed in the tool clamping portion 51 of the bending tool 4 so that the pusher element 38 can be received in such a recess. The recess 55 is disposed in such a way that the length 49 of the bending tool 4 in the tool clamping portion 51 is made shorter by the recess 55. The recess 55 is therefore a recessed region which makes the bending tool 4 narrower in a direction 48 parallel with the bending edge 47.

As a result of this design of the bending tool 4 illustrated in FIG. 7, the pusher element 38 can also be introduced between tightly aligned bending tools 4.

With reference to FIG. 2, a description will be given below of how the manipulation device 33 operates.

In order to set up the brake press 3, a bending tool 4 is taken out of the tool magazine 31 by a first manipulation device 30 and positioned in the insertion position 32 of the tool holder 19. During this operation, the pusher element 38 is as close as possible to the second deflection means 36 so that it is disposed to the right of the insertion position 32.

Once the bending tool 4 has been moved by the first manipulation device 30 into its insertion position 32 and positioned there, the second manipulation device 33, namely, the traction means 37, is set in motion by the drive 45 so that the pusher element 38 is moved in the direction of the first deflection means 35 and thus in the direction of the insertion position 32. The traction means 37 runs inside the slot 46 of the bending tool 4 and can be moved freely until the pusher element 38 comes into contact with the bending tool 4, in particular its tool clamping portion 51. Due to the traction force on the traction means 37 which is transmitted to the pusher element 38, the bending tool 4 is set in motion. The bending tool 4 is pushed along the lengthways direction 34 in the tool holder 19 until it reaches its predefined position.

To enable another bending tool 4 to be inserted in the tool holder 19, the pusher element 38 must be moved by the traction means 37 back in the direction of the second deflection means 36 so that it is positioned as close as possible to the latter in order to place another bending tool 4 in the insertion position 32 of the tool holder 19. The process of positioning the bending tool 4 is then repeated on the basis of the steps described above.

In order to set up the brake press 3 again having completed a bending operation, it must be possible to remove the bending tools 4 from the tool holder 19 again. Several different embodiments for achieving this are conceivable and will be explained.

Firstly, as illustrated in FIG. 2, at least one of the two deflection means 35, 36 can be displaced transversely to the lengthways direction 34 of the tool holder 19. In this respect, it is preferable if one or both of the deflection means 35, 36 can be displaced in a vertical direction so that the pusher element 38 can be moved downwards out of the abutment area of the bending tool 4 so that the pusher element 38 can be moved freely underneath the bending tool 4, as described in connection with FIG. 6.

Accordingly, the traction means 37 together with the pusher element 38 is moved underneath the tool clamping portion 51 of the bending tool 4 running freely in the direction of the first deflection means 35. After this step, the deflection means 35, 36 can be moved upwards so that the pusher element 38 is brought back into abutment with the bending tool 4. As a result, the bending tools 4 can be pushed by the traction means 37 and pusher element 38 in the direction of the second deflection means 36 and thus into the insertion position 32, from where it can be removed by the first manipulation device 30.

Due to the recesses 55 in the bending tool 4 illustrated in FIG. 7, not all of the bending tools 4 inserted in the tool holder 19 are necessarily pushed in the direction of the second deflection means 36 at the same time and instead, it may be that the pusher element 38 is positioned between individual bending tools 4 and only individual bending tools 4 are therefore pushed in the direction of the second deflection means 36.

To enable one or both of the deflection means 35, 36 to be positioned vertically, the latter are disposed on a vertically extending guide rail 56. The drive means used for this purpose may be an electric motor-driven, hydraulic or pneumatic displacement drive 57.

The second manipulation device 33 illustrated in FIG. 2 preferably extends more or less across a total length 58 of the tool holder 19. Consequently, the working range of such a manipulation device 33 may be made as large as possible so that the bending tools 4 can be positioned as far as possible in any position in the tool holder 19. To this end, it may be necessary for the two deflection means 35, 36 to be positioned partially outside of the tool holder 19 to enable the working range of the manipulation device 33 to be made as large as possible. Alternatively, the second deflection means 36 may be disposed such that, for example, it does not protrude laterally from the tool holder 19 and does not obstruct a tool magazine 31 disposed next to the brake press 3.

FIG. 8 illustrates another embodiment of the production plant 1 which may optionally be construed as an independent embodiment in its own right, the same reference numbers and component names being used to denote parts that are the same as those described in connection with FIGS. 1 to 7 above. To avoid unnecessary repetition, reference may be made to the more detailed description of FIGS. 1 to 7 above.

In principle, the embodiment of the production plant 1 illustrated in FIG. 8 is the same as the embodiment illustrated in FIG. 2. What is different from the embodiment illustrated in FIG. 2 is that the manipulation device 33 is designed with a bigger width. Accordingly, the manipulation device 33 extends across a sufficiently large width that the working range of the manipulation device 33 also extends across the tool magazine 31 disposed next to the brake press 3. In this case, a tool collection device 59 may be mounted in the tool magazine 31 into which several bending tools 4 can be pushed at the same time. This tool collection device 59 can ultimately be pushed into a storage area of the tool magazine 31. Consequently, individual bending tools 4 can be made ready in advance in such a tool collection device 59.

The advantage of the variant illustrated in FIG. 8 having a longer manipulation device 33 is that it is not necessary for every bending tool 4 to be pushed into the insertion position 32 individually by the first manipulation device 30 as is the case with the embodiment described as an example in connection with FIG. 2, and instead several bending tools 4 set up in readiness in the tool collection device 59 can be pushed into the tool holder 19, 20 together at the same time.

Time can be saved on the set-up process as a result of this feature because several bending tools 4 can be simultaneously transported in and/or out by means of the tool collection device 59. For example, the tool collection device 59 can be set up beforehand with bending tools 4 and the tool collection device 59 together with the bending tools 4 contained in it is then positioned at its predefined position next to the tool holder 19 ready for setting up the tools. All of the bending tools 4 that were placed in the tool collection device 59 can then be pushed into the tool holder 19 simultaneously.

In order to set up the next bending tools 4 in the brake press 3, a new tool collection device 59 with bending tools 4 already placed in it can then be positioned next to the tool holder 19 by the first manipulation device 30. Following the steps described above, the bending tools 4 can then be pushed into the tool holder 19 by means of the second manipulation device 33.

A tool collection device 59 such as that illustrated in FIG. 9 must be designed so that it is open at the bottom so that the tool collection device 59 together with the bending tools 4 contained in it can be lifted upwards. It would not be possible for a tool collection device 59 that was closed at the bottom to be lifted by the traction means 37.

In the embodiment illustrated in FIG. 9, there are two traction means 37, 60 which extend parallel with one another, the operating mode of which will be explained in more detail.

In the embodiment illustrated in FIG. 8, a second traction means 60 is also indicated in broken lines, on which a second pusher element 61 is disposed. Based on such an embodiment, the bending tools 4 can be pushed in a first direction 62 by means of the first traction means 37 and in a second direction 63 by means of the second traction means 60. As a result, the two pusher elements 38, 61 can be disposed on the bending tools 4 respectively to one side of the lengthways direction 34. As a result of this embodiment, neither of the pusher elements 38, 61 has to be pushed in the lengthways direction 34 to the opposite side of the bending tools 4. This being the case, the guide rail 56 and/or displacement drive 57 described above can be dispensed with in an alternative embodiment.

FIG. 10 is a schematic diagram in which the deflection means 35, 36 are provided in the form of spindles reeled with multiple times. This represents another embodiment of the design of the deflection means 35, 36 and can be used in combination with the embodiments described above.

FIG. 11 is a schematic diagram of another embodiment in which the deflection means 35, 36 are provided in the form of cable drums 64. In this instance, the traction means 37 is wound alternately on one of the cable drums 64 so that the pusher element 38 can be pushed along the lengthways direction 34 in the tool holder 19. The two cable drums 64 must be synchronized with one another in terms of their rotation speed in this case.

FIG. 12 is a schematic diagram illustrating another embodiment of the manipulation device 33 provided with a guide element 65 which is able to lift the traction means 37 and the pusher element 38 mounted on the traction means 37 can therefore be moved into abutment with a bending tool 4. As a result, the two deflection means 35, 36 do not have to be moved in terms of their horizontal position. The horizontal spacing of the two deflection means 35, 36 merely has to be adapted to the displacement of the traction means 37. Such a guide element 65 may be provided in the form of a guide rail, for example, which can be lifted in the vertical direction in order to move the pusher element 38 into abutment with the bending tool 4. Alternatively, the guide element 65 may be provided in the form of two pulleys which are able to lift the traction means.

FIGS. 2 to 12 illustrate different and optionally independent embodiments of the production plant 1, the same reference numbers and component names being used to denote parts that are the same as those described in connection with the preceding drawings. To avoid unnecessary repetition, reference may be made to the more detailed descriptions of the preceding drawings.

The embodiments illustrated as examples represent possible variants of the production plant 1 and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

Furthermore, individual features or combinations of features from the different embodiments illustrated and described may be construed as independent inventive solutions or solutions proposed by the invention in their own right.

The objective underlying the independent inventive solutions may be found in the description.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Above all, the individual embodiments of the subject matter illustrated in FIGS. 2 to 12 constitute independent solutions proposed by the invention in their own right. The objectives and associated solutions proposed by the invention may be found in the detailed descriptions of these drawings.

For the sake of good order, it should finally be pointed out that in order to provide a clearer understanding of the structure of the production plant 1, it and its constituent parts have been illustrated out of scale to a certain extent and/or on an enlarged and/or reduced scale.

| List of reference numbers | |
|---|---|
| 1 | Production plant |
| 2 | Workpiece |
| 3 | Bending press |
| 4 | Bending tool |
| 5 | Bending punch |
| 6 | Bending die |
| 7 | Machine frame |
| 8 | Base plate |
| 9 | Side panel |
| 10 | Side panel |
| 11 | Transverse bracing |
| 12 | Front face |
| 13 | First press beam |
| 14 | Front face |
| 15 | Linear guide |
| 16 | Second press beam |
| 17 | End face |
| 18 | End face |
| 19 | First tool holder |
| 20 | Second tool holder |
| 21 | Drive system |
| 22 | Drive means |
| 23 | Power supply network |
| 24 | Control device |
| 25 | Input terminal |
| 26 | Spindle drive |
| 27 | Actuator means |
| 28 | Orifice |
| 29 | Orifice |
| 30 | First manipulation device |
| 31 | Tool magazine |
| 32 | Insertion position |
| 33 | Second manipulation device |
| 34 | Lengthways direction |
| 35 | First deflection means |
| 36 | Second deflection means |
| 37 | First traction means |
| 38 | pusher element |
| 39 | Cable |
| 40 | Cable diameter |
| 41 | Diameter |
| 42 | Parting plane |
| 43 | Fixing means |
| 44 | Pulley |
| 45 | Drive |
| 46 | Slot |
| 47 | Bending edge |
| 48 | Parallel direction |
| 49 | Length |
| 50 | Width |
| 51 | Tool clamping portion |
| 52 | Partial portion |
| 53 | Cross-section |
| 54 | Depth |
| 55 | Recess |
| 56 | Guide rail |
| 57 | Displacement drive |
| 58 | Total length |
| 59 | Tool collection device |
| 60 | Second traction means |
| 61 | Second pusher element |
| 62 | First direction |
| 63 | Second direction |
| 64 | Cable drum |
| 65 | Guide element |

The invention claimed is:

1. A production plant comprising:

(a) a brake press comprising a machine frame, press beams secured to the machine frame, and slot-shaped tool holders disposed and/or arranged on the press beams;

(b) a bending tool comprising a bending punch or a bending die;

(c) a tool magazine for the bending tool;

(d) a first manipulation device for transporting the bending tool between the tool magazine and the tool holders; and (e) a second manipulation device for positioning the bending tool, the second manipulation device comprising a first deflector, a second deflector, at least one traction device guided via the first deflector and the second deflector device, and at least one pusher element provided on the at least one traction device;

wherein the bending tool has at least one slot extending across a length of the bending tool in a direction parallel with a bending edge of the bending tool;

wherein the at least one traction is configured to move through the at least one slot; and wherein the at least one slot is dimensioned such that the at least one pusher element cannot enter the slot.

2. The production plant according to claim 1, wherein the at least one traction device comprises a cable (39).

3. The production plant according to claim 1, wherein the at least one pusher element extends around the traction device and is of a substantially rotationally symmetrical shape.

4. The production plant according to claim 1, wherein the tool holder has a tool holder length and wherein the working range of the at least one traction device extends substantially entirely across the tool holder length.

5. The production plant according to claim 1, wherein the second manipulation device is positioned such that at least a partial portion of the at least one traction device extends inside a cross-section of the slot-shaped tool holder so that the at least one traction device can be moved into abutment with the bending tool.

6. The production plant according to claim 1, wherein first and second traction devices are provided, wherein the first traction device sets up the bending tool so that the bending tool can be positioned in a first direction, and the second traction device positions the bending tool in a second direction opposite the first direction.

7. The production plant according to claim 1, wherein the at least one traction device comprises a cable-shaped traction device, wherein the second manipulation device comprises at least two cable drums connected to a drive unit, wherein the cable-shaped traction is tensioned between the at least two cable drums and alternately reeled on the at least two cable drums.

8. The production plant according to claim 1, wherein the second manipulation manipulation device comprises at least one drive unit coupled in a driving arrangement with the first deflector, wherein the at least one drive unit is configured to move and position the at least one traction, and the at least one traction device comprises a circulating endless traction device.

9. The production plant according to claim 8, wherein the first deflector comprises a pulley.

10. The production plant according to claim 5, wherein the pusher element is secured to the partial portion of the at least one traction device and the first deflector is displaceable transversely to the the bending tool holder so that the pusher element is moved into abutment with the bending tool.

11. The production plant according to claim 10, wherein a guide element is provided between the first deflector and the second deflector, wherein the guide element is displaceable transversely to the bending tool and acts on the partial portion so that the pusher element is moved into abutment with the bending tool.

12. The production plant according to claim 1, wherein the at least one traction device is reeled multiple times around the first deflector.

* * * * *